US006436883B1

(12) United States Patent
Nieh

(10) Patent No.: US 6,436,883 B1
(45) Date of Patent: Aug. 20, 2002

(54) HYDRAULIC AND GEAR LUBRICANTS

(75) Inventor: Edward Chung-Yit Nieh, Austin, TX (US)

(73) Assignee: Huntsman Petrochemical Corporation, Austin, TX (US)

( * ) Notice: Subject to any disclaimer, the term of this patent is extended or adjusted under 35 U.S.C. 154(b) by 0 days.

(21) Appl. No.: 09/827,526

(22) Filed: Apr. 6, 2001

(51) Int. Cl.[7] ..... C10M 107/34
(52) U.S. Cl. ..... 508/579; 508/539; 508/562
(58) Field of Search ..... 508/579

(56) References Cited

U.S. PATENT DOCUMENTS

| | | | | | |
|---|---|---|---|---|---|
| 2,403,067 | A | | 7/1946 | Fischer et al. | 252/51 |
| 2,892,854 | A | | 6/1959 | Hommer | 260/404 |
| 2,967,831 | A | | 1/1961 | Hommer | 252/77 |
| 4,151,101 | A | | 4/1979 | Anzenberger, Sr. et al. | 252/49.6 |
| 4,208,293 | A | | 6/1980 | Zaweski | 252/51.5 A |
| 4,293,432 | A | | 10/1981 | Papay et al. | 252/49.9 |
| 4,557,846 | A | | 12/1985 | Wisotsky | 252/51.1 A |
| 4,828,737 | A | * | 5/1989 | Sandberg et al. | 508/579 |
| 5,259,970 | A | * | 11/1993 | Kanamori et al. | 252/73 |
| 5,415,896 | A | * | 5/1995 | Mulvihill et al. | 427/388.4 |
| 5,543,068 | A | * | 8/1996 | Kaimai et al. | 252/68 |
| 5,559,087 | A | * | 9/1996 | Halsrud et al. | 508/579 |
| 5,711,896 | A | * | 1/1998 | Kaimai | 252/68 |
| 6,133,211 | A | * | 10/2000 | Cobianco et al. | 508/579 |
| 6,255,263 | B1 | * | 7/2001 | Ryan | 508/579 |

OTHER PUBLICATIONS

Union Carbide technical bulletin for UCON® Hydraulic Fluid WS–34 (1991).

"Field Experience with a new Generation polyether polyol hydraulic fluid" from American Chemical Technologies, Inc. (date unknown, but the date at the top of our fax is Mar. 1, 2000).

* cited by examiner

*Primary Examiner*—Ellen M. McAvoy
(74) *Attorney, Agent, or Firm*—Russell R. Stolle; Ron D. Brown; Christopher J. Whewell

(57) ABSTRACT

Provided herein are functional fluid compositions useful in hydraulic fluid and gear oil formulations. The formulations according to the invention include a predominant amount of at least one polyoxyalkylene glycol derived from the addition polymerization of an alcohol in the presence of an alkylene oxide mixture which contains a substantial amount of ethylene oxide. Fluids according to the invention exhibit suitable lubricity and stability characteristics and are generally water soluble to a degree sufficient to preclude formation of a sheen on the surface of a body of water into which a fluid according to the invention is brought into contact.

20 Claims, No Drawings

HYDRAULIC AND GEAR LUBRICANTS

FIELD OF THE INVENTION

The present invention relates to hydraulic fluids useful in a wide variety of applications where a hydraulic fluid is employed to transmit fluid pressure. The invention relates more particularly to hydraulic fluids which are intended to be used in locations near environmental water sources, such as streams, rivers, lakes, and oceans. The fluids according to the invention possess strong dispersant qualities sufficient to leave no sheen in cases of their accidental release to environmental water sources. The hydraulic fluids of the invention are extremely low in toxicity to aquatic life and thus pose a minimal risk to ecosystems.

BACKGROUND

Hydraulic fluids are used in systems which are generally well-known in the art for providing a means for transmitting any applying large forces to moveable mechanical components, while retaining a great degree of flexibility and control. Such systems are used in most forms of mechanized motion to transmit, transform and control mechanical work. They are part of a major technical discipline known to those skilled in the art as "fluid power technology".

A typical hydraulic system includes the following components: 1) a force-generating unit that converts mechanical energy into hydraulic energy, such as a pump; 2) a hydraulic fluid; 3) piping for transmitting fluid under pressure; 4) a unit that converts the hydraulic energy of the fluid into mechanical work, such as an actuator or fluid motor; 5) A control circuit with valves that regulate flow, pressure, direction of movement, and applied forces; and 6) a fluid reservoir that allows for filtration and/or separation of any particulate debris or water before returning the clean fluid to the system. Thus, the fluid is in contact with each mechanical component of the system used for transmitting mechanical energy, including metallic components which may come into direct physical contact with one another.

It is generally accepted that hydraulic fluids can be defined as any liquids which are necessary for the proper functioning of a hydraulic system. The primary function of the fluid is to transmit force which is applied at one point in the system to some other location in the system, and to quickly produce desired changes in the direction or the magnitude of that force. Hydraulic systems using such suitable fluids are very common and have numerous applications in industry and daily life, including uses in automotive systems such as brakes, clutches, and transmissions, in industrial equipment for applications such as pressing, molding, mining, metal forming and positioning, excavation equipment such as backhoes, in devices such as elevators, and in the transportation industry for many control and motive systems in ships and aircraft. The art of hydraulic fluid formulation contains several technical references which describe hydraulic fluids which are based upon hydrocarbon oils. Such systems include those described in U.S. Pat. Nos. 2,403,067; 2,892,854; 2,967,831; 4,151,101; 4,208,293; 4,293,432; and 4,557,846, the entire contents of each of which are herein incorporated by reference thereto.

For optimal functioning, a hydraulic fluid must be relatively incompressible and must flow readily. In addition, there are a number of secondary functions provided by hydraulic fluids, which functions are extremely important for successful system operation, including adequate lubricity for moving parts, stability under anticipated conditions of use, compatibility with materials used to construct the hydraulic system, and the fluids should have the ability to protect system components against chemical reaction with materials which may enter the system.

Additives to the fluid which protect system components against chemical reaction are frequently called "corrosion inhibitors". Corrosion can result from the formation of reactive decomposition products of the fluid itself, from components of the fluid (e.g., additives) which are corrosive, or from the entry of contaminants into the hydraulic system.

In the case of hydraulic fluids which are based upon hydrocarbon oils, an environmental problem arises when such fluids come into contact with environmental water sources in that at least a portion of the oils tend to float on the surface of the water and create an unsightly sheen which may extend or be visible for great distances. This is known to be the case even when the total amount of the oil accidentally spilled is relatively small, and the concentration of the oil on surface of the water poses potential harm to aquatic life forms. Such situations have in the past commonly arisen for ships at sea, when there is a leak of a hydraulic fluid used in one of the ship's operating systems, and in general in any situation where hydraulic fluids are used in close proximity to environmental water sources, such as oil drilling platforms, paper mills, and amusement parks. As the United States government has promulgated rules concerning releases of materials that useful as hydraulic fluids in Title 40 of the Code of Federal Regulations, section 110, an increased level of awareness of issues surrounding spills of hazardous oils has become manifest in recent years. In response with such rulemaking, many users of hydraulic oils have undertaken to employ special precautions in their handling and use of hydraulic fluids. Clearly, if formulations of hydraulic fluids were available that do not form a sheen on the surface of water into which such fluids came into contact and which are environmentally benign, such fluids would be welcomed by all persons to whom such fluid types are of practical use.

SUMMARY OF THE INVENTION

The problems associated with the use of and release into environmental waters of water-immiscible, hydrocarbon oil based hydraulic oil formulations may be eliminated by the use of a liquid composition according to the present invention, which comprises water-soluble polyoxyalkylene glycols having either of the general formulae:

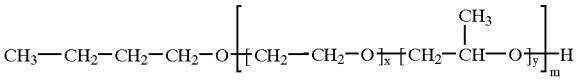

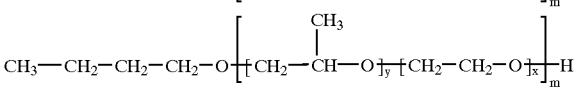

in which x is selected from any whole integer 1, 2, 3, 4, or 5; y is selected from 1 or 2; and m is an integer sufficient to provide a molecular weight in the range of between about 450 and 5000. Such materials are used in combination with a carboxylic acid having between about 6 and 18 carbon atoms per molecule of carboxylic acid, an amine, and optionally, an extreme pressure additive to provide a composition according to the invention. Since the physical properties and performance characteristics required of hydraulic fluids are similar to those required by gear oils in many applications, the formulations of the invention are of widespread applicability.

DETAILED DESCRIPTION

The present invention comprises multi-component liquid compositions of matter which comprise a predominant amount of a water-soluble polyoxyalkylene glycol having a pre-selected molecular weight of any value in the range of between 450 and 5000. When formulated according to the present invention, the functional fluids disclosed provide an excellent viscosity index which is greater than about 160. An especially preferred family of water soluble polyoxyalkylene glycol useful in the compositions of the present invention may also be one produced from alkoxylation of n-butanol with a mixture of alkylene oxides to form a random alkoxylated product which may be described by the either of the general formulae:

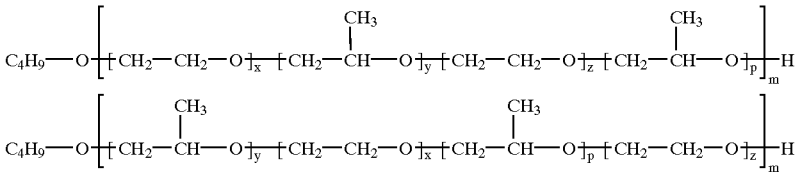

in which x may independently be any whole integer between 0 and 5, including 0 and 5; y may independently be any integer between 0 and 2, including 0 and 2; may independently be any whole integer between 1 and 5, including 1 and 5; p may independently be either 1 or 2; wherein m is an integer within the range suitable to provide a molecular weight of between 450 to 5000.

Functional fluids according to the invention possess a pour point of less than about −20° C., and exhibit compatibility with a wide range of anti-wear additive and extreme pressure additives. The formulations according to the invention also are devoid of fatigue failure that is normally expected by those of ordinary skill in the art when dealing with polar lubricant base stocks. This is evident from the comparison of the performance of similarly formulated butyl (polyoxypropylene only) based hydraulic fluids with those of the preferred form of the invention which are butyl (oxyethylene/oxypropylene).

It has been unexpectedly discovered that when normally highly oil soluble extreme pressure additives are used in a formulation according to the invention and when a formulation according to the invention is spilled into a body of water, no sheen or oily layer on the surface of the water is visually detectable and the water surface is not discolored in any noticeable way. Such normally highly oil soluble extreme pressure additives include triisopropylphenyl phosphate.

The Polyoxvalkylene Glycol Component

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide or propylene oxide to addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100 degrees C. to 160 degrees C. It is well known fact that the potassium hydroxide being a catalyst is for the most part bonded to the chain-end of the produced polyalkylene oxide in a form of alkoxide in the polymer solution so obtained.

Useful as components in a formulation according to the present invention are those polyoxyalkylene glycols described by either of the general formulae:

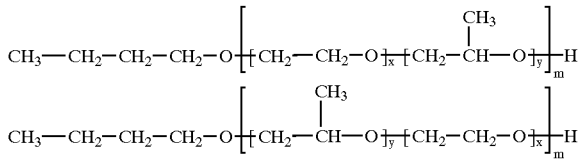

in which x may independently be any whole integer between 1 and 5; and y may independently be either 1 or 2; and m is sufficient to provide a material having a molecular weight in the range of 450 to 5000.

An especially preferred family of water soluble polyoxyalkylene glycol useful in the compositions of the present invention may also be one produced from alkoxylation of n-butanol with a mixture of alkylene oxides to form a random alkoxylated product which may be described by the either of the general formulae:

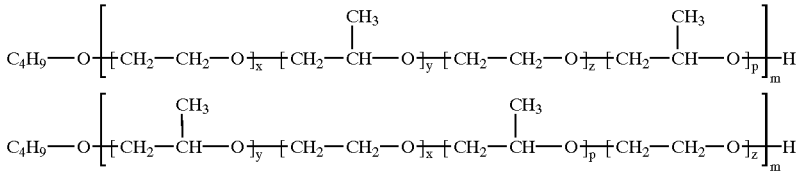

in which x may independently be any whole integer between 0 and 5, including 0 and 5; y may independently be either 1 or 2; z may independently be any whole integer between 1 and 5, including 1 and 5; p may independently be 1 or 2; and wherein m is an integer sufficient to provide a molecular weight in the range of 450 to 5000, subject to the provisos that at least one of x and z is equal to at least one and that at least one of y and p is equal to at least one.

It has been surprisingly found that hydraulic fluids prepared in accordance with the present invention which are made using a mixture of propylene oxide and ethylene oxide and n-butanol exhibit surprisingly low levels of toxicity while retaining adequate lubricity properties and dispersability characteristics for hydraulic fluid applications. Thus, preferred polyoxyalkylene glycols useful in accordance with the present invention are those prepared using n-butanol as a starting material, and subjecting n-butanol to polymerization conditions in the presence of a mixture of propylene oxide and ethylene oxide, in which the amount of propylene oxide in the gaseous mixture is preferably between 35.00% and 65.00% by weight based upon the total weight of the mixture, including every hundredth percentage therebetween, more preferably between 35.00% and 65.00% by weight based upon the total weight of the gaseous mixture, including every hundredth percentage therebetween, and most preferably between 45.00% and 55.00% by weight based upon the total weight of the gaseous mixture, including every hundredth percentage therebetween.

In order to produce a polyoxyalkylene glycol monobutyl ether with minimum polyoxyalkylene glycol contamination, it has been found beneficial to use an initiator for the polymerization, with a butanol-derived species that already contains one, two, or three alkylene oxide units per molecule such as a glycol ether represented by the formula:

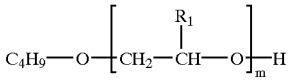

wherein $R_1$ is methyl or hydrogen and wherein m is independently selected from 1, 2, or 3 being especially preferred. These glycol ether initiators have a sufficiently low vapor pressure that allows the stripping of water from a mixture of the initiator and potassium hydroxide, and prevents unwanted polyoxyalkylene glycol by-product formation. Various suitable polyoxyalkylene glycols monobutyl ether for this invention are available from Huntsman Petrochemical Corporation having an office at 7114 North Lamar Blvd. in Austin, Tex. under the JEFFOX® tradename. Products of these alkoxylation reactions such as JEFFOX WL-170, JEFFOX® WL-260, JEFFOX® WL-660, and JEFFOX® WL-5000 having molecular weight ranges of about 450 to 5000 are useful as a component of formulations useful as a hydraulic fluid. JEFFOX® WL-170, has a number average molecular weight of about 450 and is useful as a component of formulations useful as a hydraulic fluid. JEFFOX® WL-260 has a number average of about 750 and is useful as a component of formulations useful as a hydraulic fluid. JEFFOX® WL-660 has a number average molecular of about 1800 and is useful as a component of formulations useful as a hydraulic fluid. JEFFOX(D WL-5000 has a number average of about 4200 and is useful as a component of formulations useful as a hydraulic fluid.

The Extreme Pressure Additive Component

For purposes of this specification and the appended claims the words "extreme pressure additive" means those particular chemical materials generally regarded by artisans of ordinary skill in the lubrication or tribology arts as being useful as extreme pressure additives for ho lubricants, which include without limitation: sulfurized olefins, dithiophosphate salts of transition metals including without limitation such exemplary salts as zinc dithiophosphate and copper dithiophosphate, derivatives of alkylated phenols including mono or poly-alkyl phenol phosphates, organic phosphates, organic sulfur and chlorine compounds, sulfurized fats, other phosphates, sulfides, di-sulfides, and polysulfides. It is most preferred, however, that the extreme pressure additive comprise a trialkyl phenol phosphate such as those available under the tradename Durad 110, Durad 150, Durad 220, and Durad 300 from Great Lake Chemical Corp., of West Lafayette, Ind., USA; or those available under the trade name of IRGALUBE® from Ciba Specialty Chemicals of Basel, Switzerland. Durad 300 is an especially preferred trialkyl phenol phosphate.

The Amine Component

Compositions according to the invention also include an amine component, the function of which is to control corrosion by maintaining the overall pH of the lubricant in the alkaline range. Preferred amines for this use include primary amines, secondary amines, tertiary amines, cycloalkyl amines, aromatic amines, diamines, polyalkylene polyamines, and include all amines generally regarded by one of ordinary skill in the art as being useful for controlling corrosion of metal surfaces by either neutralizing acids produced during equipment operation or by acting as a metal deactivator. One especially preferred amine for use in compositions according to the invention is DIGLYCOLAMINE® Agent amine product because of its ability to impart both corrosion resistance and favorable toxicology profile. DIGLYCOLAMINE® Agent is available from Huntsman Petrochemical Corporation of Austin, Tex.

Toxicity to Aquatic Life

As mentioned, fluid compositions according to the invention exhibit an especially favorable low toxicity with respect to aquatic life, which is important from an environmental standpoint because leaks of functional fluids into the environment often occur at some point during either their storage, transportation, or use. Table I provides comparative data between monobutyl ethers which have been addition polymerized with different olefin oxides to different molecular weights. The olefin oxides used were propylene oxide ("PO") and ethylene oxide ("EO"). In one set of data, pure propylene oxide was used. In another set of data, a 50:50 mixture (molar basis) of propylene oxide and ethylene oxide was used in the polymerization. A third set of data was obtained for the butane di-ol based products in which a 75:25 molar mixture of EO to PO was employed during the polymerization.

TABLE I aquatic toxicity of various polyalkylene glycols

| Type of Molecule | Oxide | Molecular Weight | Poly-G ® Fluid Equivalents | Sturm Biodegradation | Concentrations (mg/L) 96-hr fathead minnow acute toxicity, $LC_{50}$[1] | 48-hr Daphnia Magna acute toxicity, $EC_{50}$[2] | Bacterial inhibition, $IC_{50}$[3] |
|---|---|---|---|---|---|---|---|
| Monobutyl Ether | 100% PO | 340 | WI-65 | 84 | 190 | 450 | 2,800 |
| | | 740 | WI-165 | 99 | 86 | 250 | 1,300 |
| | | 1,020 | WI-285 | 85 | 37 | 69 | 34,000 |
| | | 1,550 | WI-625 | 48 | 20 | 26 | 19,000 |
| | | 2,490 | WI-1715 | 23 | 180 | 520 | >50,000 |

TABLE I-continued aquatic toxicity of various polyalkylene glycols

| Type of Molecule | Oxide | Molecular Weight | Poly-G ® Fluid Equivalents | Sturm Biodegradation | Concentrations (mg/L) 96-hr fathead minnow acute toxicity, $LC_{50}$[1] | 48-hr Daphnia Magna acute toxicity, $EC_{50}$[2] | Bacterial inhibition, $IC_{50}$[3] |
|---|---|---|---|---|---|---|---|
| Monobutyl Ether | 100% PO | 520 | WS-100 | 93 | 3,200 | 4,300 | 18,500 |
| | | 970 | WS-260 | 65 | 13,000 | 5,400 | 40,000 |
| | | 1,700 | WS-660 | 45 | 24,500 | 21,000 | 32,000 |
| | | 3,930 | WS-3520 | 7 | 11,900 | 17,000 | 10,000 |
| Di-ol | 72:25 EO/PO | 2,470 | WT-1400 | 71 | 129,000 | 88,000 | 38,000 |
| | | 12,000 | WT-90,000 | 8 | 65,000 | 83,000 | 94,000 |
| Water/glycol hydraulic fluid concentrate | — | — | — | 57 | 6,700 | 1,400 | 36,000 |
| Water/glycol hydraulic fluid | — | — | — | 64 | 4,500 | 4,800 | 22,000 |

$LC_{50}$ = median lethal concentration (expected 50% mortality)
$EC_{50}$ = median effect concentration (expected 50% loss of mobility)
$IC_{50}$ = median inhibition concentration (expected 50% loss of respiration)

As is evident from the data in table I, polyoxyalkylene glycols produced using substantial amounts of ethylene oxide during the addition polymerization exhibit a much greatly reduced degree of toxicity with respect to those polyoxyalkylene glycols produced using only propylene oxide during the addition polymerization. Thus, the predominant ingredient in formulations according to this invention are seen to be of very low toxicity. Poly-G® is a trademark of Olin Corporation, and the various product equivalents indicate that these materials are available from Olin Corporation of Norwalk, Conn. The prefix WS, WI, and WT each mean water-soluble, water-insoluble, and water-thickening, respectively, and the number after the prefix indicates the approximate viscosity in Saybolt Universal Seconds (SUS) at 38° C. (100° F.).

Fluid Formulations

Formulations according to the invention will generally comprise the following components in the listed amounts, wherein all parts and/or percentages are by weight: Carboxylic acid: 1 to 2%; Amine: 0.75 to 1.6%; extreme pressure additive: 1 to 1.5%; and optional fire retardant at about 0.5%. Formulations of finished products according to this invention are set for the below. In general, it is preferred in accordance with the invention to employ polyoxyalkylene glycols having a molecular weight in the range of 750–2000 for use in fluids to be used where a hydraulic fluid is needed, and it is preferable to use a polyoxyalkylene glycol having a molecular weight in the range of 2000–5000 for use in gear oils.

EXAMPLE 1

| | |
|---|---|
| JEFFOX ® PPG-400 | 25 |
| JEFFOX ® WL-260 | 70.2 |

-continued

| | |
|---|---|
| Decanoic acid | 1.5 |
| DIGLYCOLAMINE ® Agent | 1.3 |
| Phenothiazine | 0.5 |
| DURAD-300 | 1.5 |

EXAMPLE 2

| | |
|---|---|
| JEFFOX ® WL-170 | 20 |
| JEFFOX ® WL-260 | 75.2 |
| Decanoic acid | 1.5 |
| DIGLYCOLAMINE ® Agent | 1.3 |
| Phenothiazine | 0.5 |
| DURAD-300 | 1.5 |

EXAMPLE 3

| | |
|---|---|
| JEFFOX ® PPG-400 | 25 |
| JEFFOX ® WL-260 | 71.5 |
| N-phenyl-1-naphthylamine | 2.0 |
| DURAD-300 | 1.5 |

EXAMPLE 4

| | |
|---|---|
| JEFFOX ® WL-660 | 25 |
| JEFFOX ® WL-260 | 75.2 |
| Decanoic acid | 1.5 |
| DIGLYCOLAMINE ® Agent | 1.3 |
| Phenothiazine | 0.5 |
| DURAD-300 | 1.5 |

EXAMPLE 5

| | |
|---|---|
| JEFFOX ® WL-660 | 20.5 |
| JEFFOX ® WL-260 | 77.5 |
| N-phenyl-1-naphthylamine | 2.0 |
| DURAD-300 | 1.5 |

EXAMPLE 6

| | |
|---|---|
| JEFFOX ® WL-660 | 33.5 |
| JEFFOX ® WL-260 | 63.0 |
| N-phenyl-1-naphthylamine | 2.0 |
| DURAD-300 | 1.5 |

EXAMPLE 7

| | |
|---|---|
| JEFFOX ® WL-660 | 77.15 |
| JEFFOX ® WL-5000 | 17.5 |
| Decanoic acid | 0.85 |
| Phenothiazine | 2.0 |
| DURAD-300 | 1.5 |

EXAMPLE 8

| | |
|---|---|
| JEFFOX ® WL-660 | 79.0 |
| JEFFOX ® WL-5000 | 17.5 |
| Decanoic acid | 0.85 |
| N-phenyl-1-naphthylamine | 2.0 |
| DURAD-300 | 1.5 |

EXAMPLE 9

| | |
|---|---|
| JEFFOX ® WL-660 | 42.65 |
| JEFFOX ® WL-5000 | 52 |
| Decanoic acid | 1.0 |
| DIGLYCOLAMINE ® Agent | 0.85 |
| Phenothiazine | 2.0 |
| DURAD-300 | 1.5 |

EXAMPLE 10

| | |
|---|---|
| JEFFOX ® WL-660 | 40.6 |
| JEFFOX ® WL-5000 | 55.9 |
| Phenothiazine | 2.0 |
| DURAD-300 | 1.5 |

EXAMPLE 11

| | |
|---|---|
| JEFFOX ® WL-660 | 23.15 |
| JEFFOX ® WL-5000 | 73.0 |

-continued

| | |
|---|---|
| Decanoic acid | 1.0 |
| DIGLYCOLAMINE ® Agent | 0.85 |
| Phenothiazine | 0.5 |
| DURAD-300 | 1.5 |

EXAMPLE 12

| | |
|---|---|
| JEFFOX ® WL-660 | 23.0 |
| JEFFOX ® WL-5000 | 73.5 |
| Phenothiazine | 2.0 |
| DURAD-300 | 1.5 |

EXAMPLE 13

| | |
|---|---|
| UCON LB-165 | 39.0 |
| UCON LB-285 | 56.2 |
| Decanoic acid | 1.5 |
| DIGLYCOLAMINE ® Agent | 1.3 |
| Phenothiazine | 0.5 |
| DURAD-300 | 1.5 |

EXAMPLE 14

| | |
|---|---|
| UCON LB-165 | 20.2 |
| UCON LB-285 | 75.0 |
| Decanoic acid | 1.5 |
| DIGLYCOLAMINE ® Agent | 1.3 |
| Phenothiazine | 0.5 |
| DURAD-300 | 1.5 |

These formulations are useful as hydraulic fluids and gear lubes. The fluids of this invention are blends of the various components set forth. To produce a blended fluid in accordance with the invention, one merely mixes the various ingredients in a mixing kettle with gentle agitation until a homogeneous mixture results.

One important property of formulations of hydraulic oils and gear lubes in general is that they should be relatively tolerant of impurities introduced thereinto, without suffering deleterious effects on their performance properties. In table II below are set forth results of the evaluation of the presence of various contaminants in a formulation according to the invention.

TABLE II effect of contaminants on various formulations according to the invention.

| Example # | Contaminant | % contaminant | Drops in 2 Kg H2O | Observation |
|---|---|---|---|---|
| 2 | ECO-SAFE FR-46 | 3 | 5 | no sheen |
| 4 | ECO-SAFE FR-46 | 3 | 5 | no sheen |
| 6 | ECO-SAFE FR-46 | 3 | 5 | no sheen |
| 3 | ECO-SAFE FR-46 | 3 | 5 | no sheen |
| 13 | ECO-SAFE FR-46 | 3 | 1 | two-phase |
| 14 | ECO-SAFE FR-46 | 3 | 1 | two-phase |
| 2 | FM-HYDRAULIC AW46 | 3 | 5 | no sheen |
| 4 | FM-HYDRAULIC AW46 | 3 | 5 | no sheen |
| 6 | FM-HYDRAULIC AW46 | 3 | 5 | no sheen |
| 3 | FM-HYDRAULIC AW46 | 2 | 5 | no sheen |
| 13 | FM-HYDRAULIC AW46 | 3 | 1 | two-phase |
| 14 | FM-HYDRAULIC AW46 | 3 | 1 | two-phase |
| 2 | FM-HYDRAULIC AW68 | 2 | 5 | no sheen |
| 4 | FM-HYDRAULIC AW68 | 2 | 5 | no sheen |
| 6 | FM-HYDRAULIC AW68 | 2 | 5 | no sheen |
| 3 | FM-HYDRAULIC AW68 | 3 | 5 | no sheen |
| 13 | FM-HYDRAULIC AW68 | 3 | 1 | two-phase |
| 14 | FM-HYDRAULIC AW68 | 3 | 1 | two-phase |
| 3 | BIOHYDRAN | 3 | 5 | no sheen |
| 4 | BIOHYDRAN | 3 | 5 | no sheen |
| 6 | BIOHYDRAN | 3 | 5 | no sheen |
| 3 | BIOHYDRAN | 3 | 5 | no sheen |
| 13 | BIOHYDRAN | 3 | 1 | two-phase |
| 14 | BIOHYDRAN | 3 | 1 | two-phase |
| Reference | ECO-SAFE FR-46 | 100 | 1 | dispersed sheen |
| Reference | FM-HYDRAULIC AW46 | 100 | 1 | dispersed sheen |
| Reference | FM-HYDRAULIC AW68 | 100 | 1 | dispersed sheen |
| Reference | BIOHYDRAN | 100 | 1 | floater |
| 13 | None | 100 | 1 | two-phase |
| 14 | None | 100 | 1 | two-phase |

In Table II are listed the example number from the examples above which were evaluated for contaminant tolerance by observing the manifestation of a sheen, or lack thereof, on the surface of a 2 liter volume of water into which the denoted number of drops of a mixture comprising 97.0 grams of the particular formulation mixed with 3.0 grams of the contaminant are added. This information is valuable in selecting a given fluid formulation according to the invention as a replacement for a fluid of prior art, for it is often the case that it is not possible to completely evacuate a hydraulic system of its fluid when replacing the fluid, and in many cases residual amounts of used fluid remaining in the system can affect the performance of the replacement fluid. The contaminant listed as "ECO-SAFE FR-46" is a polyglycol product L available from American Chemical Technologies, Inc. of 46915 Liberty Drive, Wixom, Mich. 48393 and is generally employed as a hydraulic fluid. The contaminants listed as "FM-HYDRAULIC AW46" and "FM-HYDRAULIC AW46" are available from Citgo Petroleum Corporation of 1 Warren Place, Tulsa, Okla. and are mineral oil products which are generally employed as food-grade hydraulic fluids. The contaminant listed as "BIOHYDRAN" is Biohydran 46, available from Fina Lubricants of 400 Chism Place, Plano, Texas 75075 and is a vegetable oil that is generally employed as a bio-degradable, non-toxic hydraulic fluid.

The contaminants were tested alone in their neat forms to show that they are capable of producing a sheen on the surface of water into which they are added. In table II, the last two materials from examples 13 and 14 are those made using materials known as UCON LB-165 and UCON LB-285 in their formulations. These materials are available from Union Carbide Corporation of Danbury, Conn., and are polyoxyalkylene glycols made from n-butanol and propylene oxide, i.e., no ethylene oxide is used during their manufacture. From these results it is seen that formulations made using these materials are not in the least bit compatible with water into which they may become mixed, as evidenced by the presence of two phases in the sheen test results.

In Table III are listed observations of the physical appearance of mixtures of various example formulations with the contaminants listed in the amount set forth on a weight basis.

TABLE III physical appearances of contaminated fluids according to the invention.

| Example # | Contaminant | Contaminant, % w/w 2 | 3 | 6 | 10 |
|---|---|---|---|---|---|
| 2 | ECO-SAFE FR-46 | clear | clear | clear | clear |
| 4 | ECO-SAFE FR-46 | clear | clear | clear | clear |
| 6 | ECO-SAFE FR-46 | clear | clear | clear | clear |
| 3 | ECO-SAFE FR-46 | clear | clear | clear | clear |
| 13 | ECO-SAFE FR-46 | clear | clear | clear | clear |
| 14 | ECO-SAFE FR-46 | clear | clear | clear | clear |
| 2 | FM-HYDRAULIC AW46 | clear | cloudy | cloudy | cloudy |
| 4 | FM-HYDRAULIC AW46 | clear | clear | cloudy | cloudy |
| 6 | FM-HYDRAULIC AW46 | clear | cloudy | cloudy | cloudy |
| 3 | FM-HYDRAULIC AW46 | clear | clear | cloudy | cloudy |
| 13 | FM-HYDRAULIC AW46 | clear | clear | clear | cloudy |
| 14 | FM-HYDRAULIC AW46 | clear | clear | cloudy | cloudy |
| 2 | FM-HYDRAULIC AW68 | clear | cloudy | cloudy | cloudy |
| 4 | FM-HYDRAULIC AW68 | clear | clear | cloudy | cloudy |
| 6 | FM-HYDRAULIC AW68 | clear | cloudy | cloudy | cloudy |
| 3 | FM-HYDRAULIC AW68 | clear | clear | cloudy | cloudy |
| 13 | FM-HYDRAULIC AW68 | clear | clear | clear | clear |
| 14 | FM-HYDRAULIC AW68 | clear | clear | cloudy | cloudy |

TABLE III-continued physical appearances of contaminated fluids according to the invention.

| Example # | Contaminant | Contaminant, % w/w 2 | 3 | 6 | 10 |
|---|---|---|---|---|---|
| 3 | BIOHYDRAN | clear | clear | cloudy | cloudy |
| 4 | BIOHYDRAN | clear | clear | cloudy | cloudy |
| 6 | BIOHYDRAN | clear | clear | cloudy | cloudy |
| 3 | BIOHYDRAN | clear | clear | cloudy | cloudy |
| 13 | BIOHYDRAN | clear | clear | cloudy | cloudy |
| 14 | BIOHYDRAN | clear | clear | cloudy | cloudy |

Thus, the first line in table III sets forth the appearance of the composition according to formula 3 and having 2, 3, 6, and 10 percent by weight of the contaminant ECO-SAFE FR-46.

Evaluation of the performance of fluids provided by the invention for wear characteristics and extreme pressure properties were carried out in accordance with ASTM test methods D-2670 and D-3233. Each test run in duplicate, and results of the testing are tabulated in table IV:

TABLE IV

Performance test data for wear characteristics and extreme pressure properties of selected formulations according to the invention.

| Example No. | | Wear Test (ASTM D-2670) Total Teeth Wear | E. P. Test (ASTM D-3233) Failure Load |
|---|---|---|---|
| 12 | run 1 | 6 | 1800 |
| | run 2 | 8 | 1750 |
| 10 | run 1 | 10 | 1550 |
| | run 2 | 10 | 1700 |
| 8 | run 1 | 38 | 1550 |
| | run 2 | 29 | 1725 |
| 7 | run 1 | 22 | 1725 |
| | run 2 | 24 | 1250 |
| 6 | run 1 | 5 | 2100 |
| | run 2 | 4 | 2050 |
| 3 | run 1 | seizure occurred at load | 1250 |
| | run 2 | seizure occurred at load | 1200 |
| 1 | run 1 | 13 | 1150 |
| | run 2 | 14 | 950 |
| BIOHYDRAN | run 1 | 52 | 1775 |
| 46 | run 2 | 59 | nottested |
| ECOSAFE FR- | run 1 | 8 | 1600 |
| 46 | run 2 | 7 | 1875 |

The result from table IV suggest that the wear properties and extreme pressure properties of lubricants provided by the invention compare favorably against commercially-available fluids. The results further indicate that the wear properties could be further improved by appropriate selection of anti-wear additives and extreme pressure additives.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A liquid composition of matter that is useful as a hydraulic fluid or gear oil which consists essentially of:

a) a water-soluble polyoxyalkylene glycol monobutyl ether having a molecular weight of between 450 and 5000, said polyoxyalkylene glycol monobutyl ether being derived from n-butanol and a gaseous mixture of ethylene oxide and propylene oxide, and wherein the viscosity of the polyoxyalkylene glycol monobutyl ether is between 100 and 4000 in Saybolt Universal Seconds at 38° C.;

b) a carboxylic acid having between 6 and 18 carbon atoms per molecule of carboxylic acid; and c) an amine.

2. A composition according to claim 1 further comprising an extreme pressure additive.

3. A composition according to claim 2 wherein said extreme pressure additive is selected from the group consisting of: dithiophosphate salts of transition metals, derivatives of alkylated phenols, mono-alkyl phenol phosphates, poly-alkyl phenol phosphates, organic phosphates, organic sulfur compounds, organic chlorine compounds, sulfurized fats, sulfides, di-sulfides, polysulfides, and tri-isopropylphenol phosphate.

4. A composition according to claim 1 further comprising an antioxidant.

5. A composition according to claim 4 wherein said antioxidant is selected from the group consisting of: aromatic amines, phenolic compounds, phenothiazine, di-tert-butyl-p-cresol, and p-methoxyanisole.

6. A composition according to claim 1 wherein said water-soluble polyoxyalkylene glycol is derived from n-butanol, and a gaseous mixture of ethylene oxide and propylene oxide and is described by the general formula:

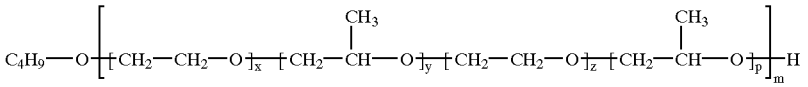

in which x is independently any whole integer between 0 and 5, including 0 and 5; y is independently any integer between 0 and 2, including 0 and 2; z is independently any whole integer between 0 and 5, including 0 and 5; p is independently either 0, 1, or 2; wherein m is an integer sufficient to provide a molecular weight in the range 450 to 5000; subject to the provisos that at least one of x and z is equal to at least one and that at least one of y and p is equal to at least one.

7. A composition according to claim 1 wherein said water-soluble polyoxyalkylene glycol is derived from n-butanol, and a gaseous mixture of ethylene oxide and propylene oxide and is described by the general formula:

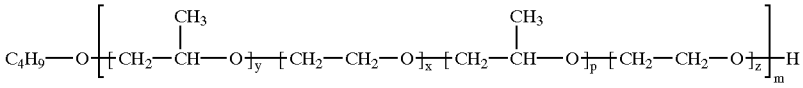

in which x is independently any whole integer between 0 and 5, including 0 and 5; y is independently any integer between 0 and 2, including 0 and 2; p is independently 0, 1, or 2; z is independently any whole integer between 0 and 5, including 0 and 5; and wherein m is an integer sufficient to provide a molecular weight between 450 and 5000, subject to the provisos that at least one of x and z is equal to at least one and that at least one of y and p is equal to at least one.

8. A composition according to claim 6 wherein the amounts of ethylene oxide and propylene oxide present in said water soluble polyoxyalkylene glycol are present in a ratio between of 0.25:1.00 to 4.00:1.00 on a molar basis, respectively, including every incremental hundredth therebetween.

9. A composition according to claim 7 wherein the amounts of ethylene oxide and propylene oxide present in said water soluble polyoxyalkylene glycol are present in a ratio between of 35:65 and 65:35 on a molar basis, respectively, and including every incremental hundredth therebetween.

10. A composition according to claim 8 wherein the amounts of ethylene oxide and propylene oxide present in said water soluble polyoxyalkylene glycol are present in a ratio of about 1:1 on a molar basis.

11. A composition according to claim 9 wherein the amounts of ethylene oxide and propylene oxide present in said water soluble polyoxyalkylene glycol are present in a ratio of about 1:1 on a molar basis.

12. A composition according to claim 6 wherein the amine is selected from the group consisting of: 2-(2-aminoethoxy) ethanol, monoethanol amine, diethanol amine, triethanol amine, 2-amino-2-methyl-1-propanol, 2-amino-2-ethyl-1,3-propanediol, mono-isopropanol amine, and di-isopropanol amine.

13. A composition according to claim 7 wherein the amine is selected from the group consisting of: 2-(2-aminoethoxy) ethanol, monoethanol amine, diethanol amine, triethanol amine, 2-amino-2-methyl-1 -propanol, 2-amino-2-ethyl-1,3-propanediol, mono-isopropanol amine, and di-isopropanol amine.

14. A composition according to claim 12 wherein the amine is 2-(2-aminoethoxy) ethanol.

15. A composition according to claim 13 wherein the amine is 2-(2-aminoethoxy) ethanol.

16. A composition according to claim 1 wherein the carboxylic acid is selected from the group consisting of: octanoic acid, nonanoic acid, decanoic acid, dodecanoic acid, and mixtures thereof.

17. A composition according to claim 1 wherein said water-soluble polyoxyalkylene glycol is present in an amount of at least 92.0% of the total the composition on a weight basis.

18. A composition according to claim 1 wherein said carboxylic acid is present in any amount between 0.75 and 2.50% on a weight basis based upon the total weight of the liquid composition, including every hundredth percent therebetween.

19. A composition according to claim 1 wherein said extreme pressure additive is present in any amount between 0.50 and 2.00% of the total the composition on a weight basis, including every hundredth percent therebetween.

20. A composition according to claim 1 wherein said amine is present in any amount between 0.50 and 2.00% of the total the composition on a weight basis, including every hundredth percent therebetween.

* * * * *